US009808659B2

(12) United States Patent
Chevalier

(10) Patent No.: US 9,808,659 B2
(45) Date of Patent: Nov. 7, 2017

(54) ROPING HARNESS

(71) Applicant: ZEDEL, Crolles (FR)

(72) Inventor: Nicolas Chevalier, St Hilaire du Touvet (FR)

(73) Assignee: ZEDEL, Crolles (FR)

( * ) Notice: Subject to any disclaimer, the term of this patent is extended or adjusted under 35 U.S.C. 154(b) by 0 days.

(21) Appl. No.: 15/145,595

(22) Filed: May 3, 2016

(65) Prior Publication Data

US 2016/0332009 A1 Nov. 17, 2016

(30) Foreign Application Priority Data

May 13, 2015 (FR) ..... 15 54350

(51) Int. Cl.
*A62B 35/04* (2006.01)
*A62B 35/00* (2006.01)

(52) U.S. Cl.
CPC ..... *A62B 35/04* (2013.01); *A62B 35/0012* (2013.01); *A62B 35/0018* (2013.01); *A62B 35/0025* (2013.01); *A62B 35/0037* (2013.01)

(58) Field of Classification Search
CPC ..... A62B 35/0012; A62B 35/0018; A62B 35/0025; A62B 35/0037; A62B 35/04
See application file for complete search history.

(56) References Cited

U.S. PATENT DOCUMENTS 5,329,884 A * 7/1994 Bell ..... A62B 35/0025 119/857
6,527,082 B1 * 3/2003 Taylor ..... A62B 35/0037 182/3
6,820,721 B1 * 11/2004 Henson ..... A62B 35/0075 182/193
8,292,028 B2 * 10/2012 Wise ..... A62B 35/0075 182/19
8,584,799 B1 * 11/2013 Dennington ..... A62B 35/0075 182/3
8,902,074 B2 * 12/2014 Landry ..... A62B 35/0018 182/3

(Continued)

FOREIGN PATENT DOCUMENTS

EP 1803487 A1 7/2007
JP 2004-141480 A 5/2004
WO 2011/121242 A1 10/2011

*Primary Examiner* — Colleen M Chavchavadze
(74) *Attorney, Agent, or Firm* — Oliff PLC

(57) ABSTRACT

A roping harness having a sit harness, pair of shoulder straps, and at least one securing link having a first strap unfurlable in the lengthwise direction, and composed of two superposed strands secured to one another by a stitching area, designed to tear when a fall happens separating the strands and moving the connecting loop from a lowered to a raised position. The securing link includes a second strap connecting the sternal attachment to the corresponding sit harness strap. The first strap bottom strand is attached to the belt and is shorter length than the unfurlable top strand. The top strand is fixed to the sternal attachment, such that tearing of the stitching area releases the bottom strand. The top strand moves to the raised position attached to the sternal attachment to transfer the reaction of the shock of a fall onto the second strap connected with the leg loops.

9 Claims, 5 Drawing Sheets

(56) References Cited

U.S. PATENT DOCUMENTS

| | | | | |
|---|---|---|---|---|
| 2005/0230184 | A1* | 10/2005 | Ansaldo | A62B 1/16 182/3 |
| 2008/0230311 | A1* | 9/2008 | Fusco | A62B 35/0062 182/37 |
| 2009/0071750 | A1* | 3/2009 | Simard | A62B 1/14 182/5 |
| 2010/0163338 | A1* | 7/2010 | Wood | A62B 35/04 182/6 |

* cited by examiner

ROPING HARNESS

BACKGROUND OF THE INVENTION

The invention relates to a roping harness comprising:

a sit harness composed of a support belt and a pair of leg loops, a pair of shoulder straps each comprising a chest strap extended by a back belt, at least one connecting loop designed to be connected to a fall arrest apparatus, and at least one securing link having a first strap unfurlable in the lengthwise direction and composed of two superposed strands secured to one another by a safety stitching area which is designed to tear in the event of a fall to separate the two strands and to move the connecting loop from a lowered position to a raised position.

STATE OF THE ART

For certain operations involving working at height, known harnesses have two ventral and/or sternal attachment loops at the front designed to be connected to a fall arrest device for user safety. The mechanical fall arrest device is arranged so as to slide along a rail or a lifeline, for example secured to a fixed vertical ladder, following the user's progression in the upwards or downwards direction. In case of a fall, the fall arrest device automatically blocks to secure the user.

Operation is facilitated when the fall arrest device is connected to the ventral loops situated in the bottom position in proximity to the belt. In case of a fall on the other hand, the user is liable to tumble upside-down and to fall headfirst.

A recent European standard imposes that each fall arrest connection point has to be located above the centre of gravity of the user after the fall.

Connection of the fall arrest device to the sternal loops would be a solution which would comply with the standard in case of a fall. However during normal progression of the user, the latter would have the fall arrest device placed permanently in front of him and close to his eyes, thereby giving rise to a certain hindrance and visual discomfort.

The documents WO2011/121242 and EP2552551 (Tractel) describe a harness comprising a metal attachment ring which, when the user falls, moves from a bottom point to a top point after tearing of the stitching system. But the ring is arranged on a horizontal securing strap extending between the front portions of the two shoulder straps. The assembly remains fixed to the belt which has to absorb the shock in case of a fall.

Movement of the connecting loop of a harness from a bottom point to a top point is furthermore known as such from the document EP 1803487.

Object of the Invention

The object of invention consists in providing an improved roping harness for working at height having a securing and comfortable roping system in both the normal progression and post-fall situations.

The harness according to the invention is characterized in that the securing link comprises a second strap connecting the sternal attachment to the strap of the corresponding sit harness, and that the bottom strand of the first strap is attached to the belt and has a shorter length than that of the unfurlable top strand, which is fixed to the sternal attachment, such that tearing of the stitching area releases the bottom strand, whereas the top strand moves to the raised position remaining attached to the sternal attachment so as to transfer the reaction of the shock undergone when a fall occurs onto the second strap which is connected with the leg loops.

This results in the connecting loops being detached from the belt, and in the forces being taken up by the sternal attachments connected with the shoulder straps of the second strap in extension of the leg loops.

According to a preferred embodiment, the connecting loop is supported by the bottom end of the top strand of the first strap and is in the lowered position above the closing loop of the belt. The link of the bottom strand with the corresponding sternal attachment is interrupted when tearing of the stitching area takes place.

Preferentially, the sternal attachment acts as common attachment means for the chest strap of the shoulder straps, the second strap, and the unfurlable top strand of the first strap.

BRIEF DESCRIPTION OF THE DRAWINGS

Other advantages and features will become more clearly apparent from the following description of an embodiment of the invention given for non-restrictive example purposes only and represented in the appended drawings, in which.

DETAILED DESCRIPTION OF THE INVENTION

Figure 1:
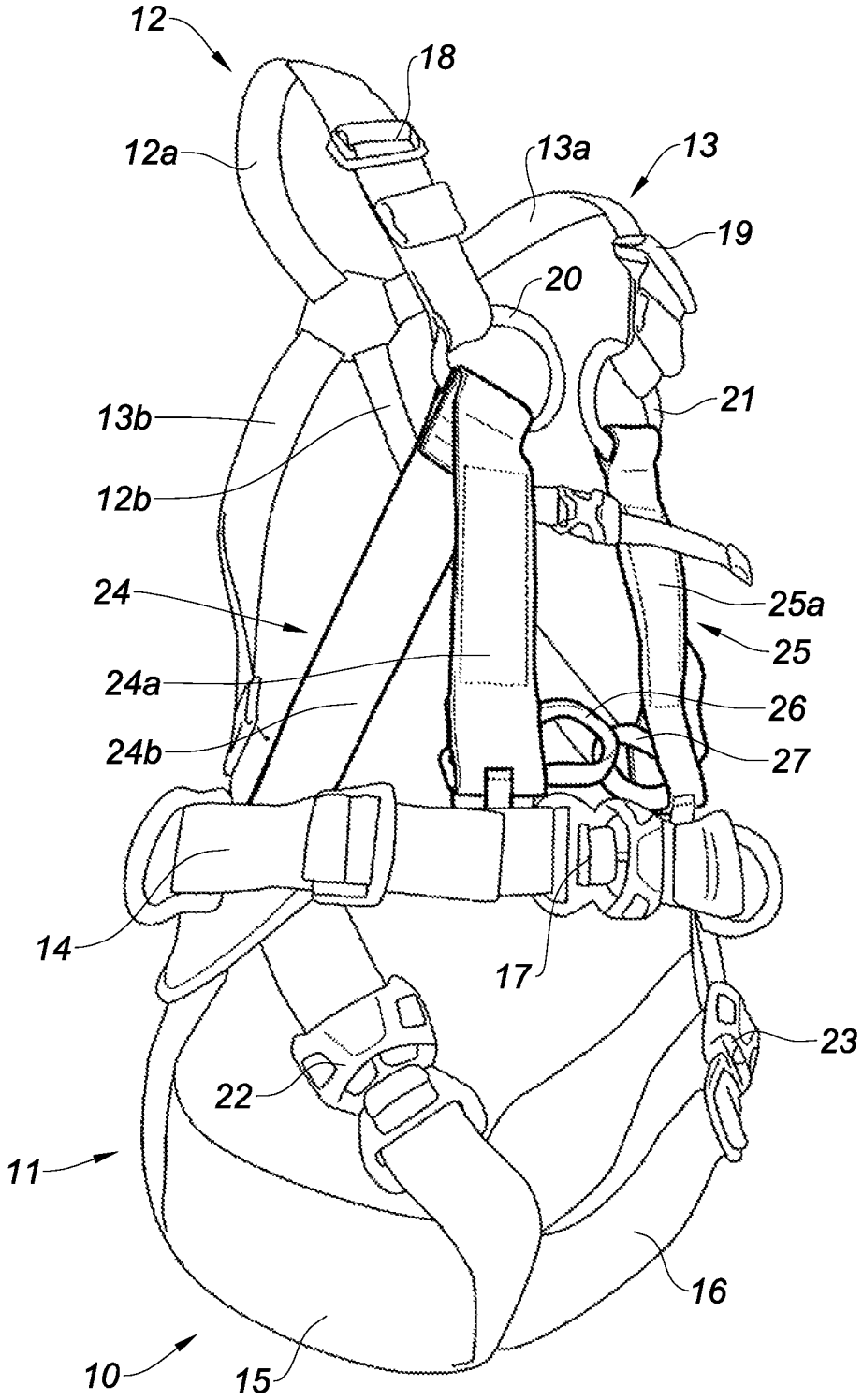
FIG. 1 is a schematic view of the harness according to the invention, with the two connecting loops situated in the lowered position and corresponding to the normal state of progression of the user.
Figure 2:
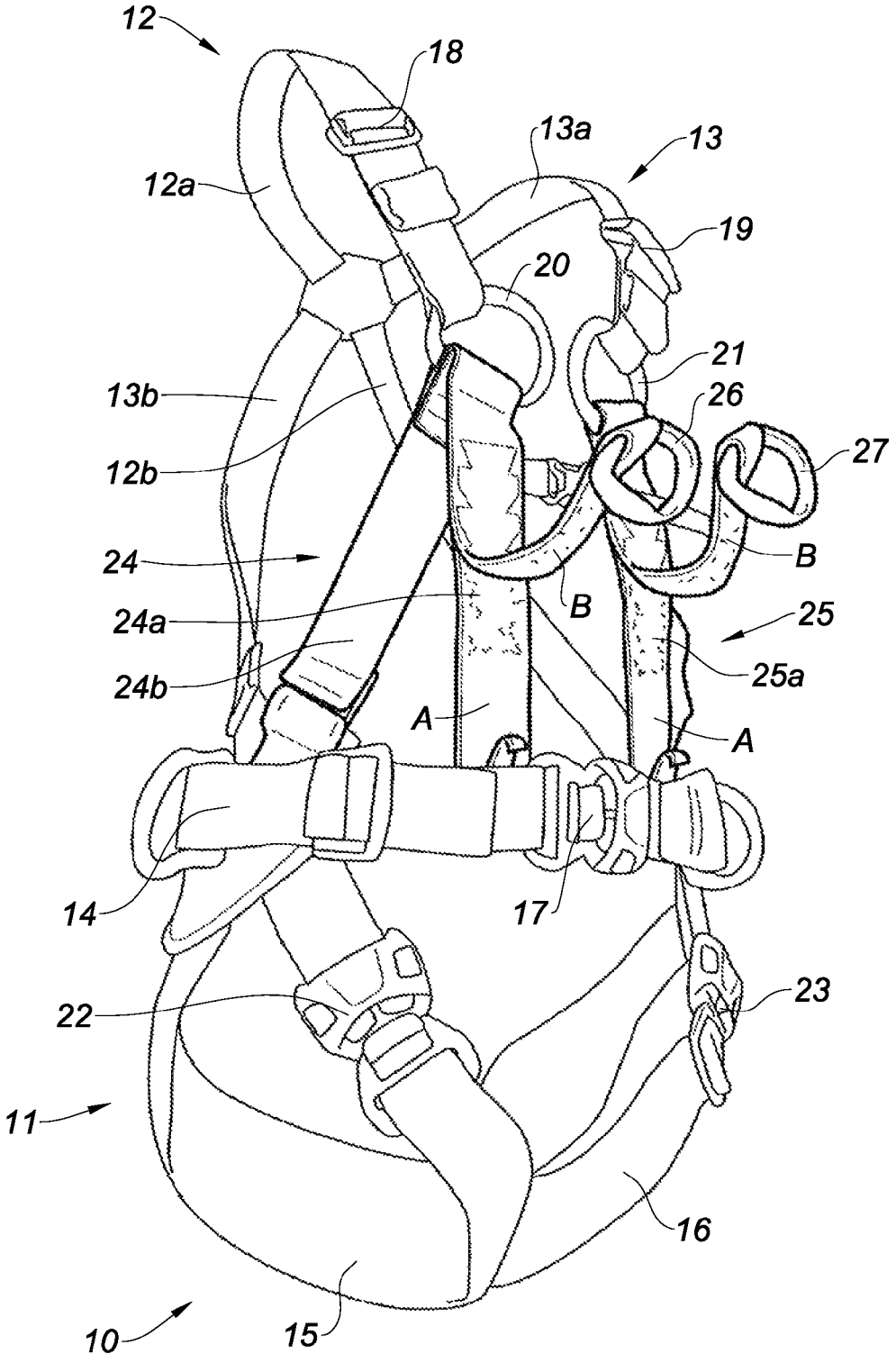
FIG. 2 represents similar views to FIG. 1, during tearing of the stitching area of the link, following a user fall.
Figure 3:
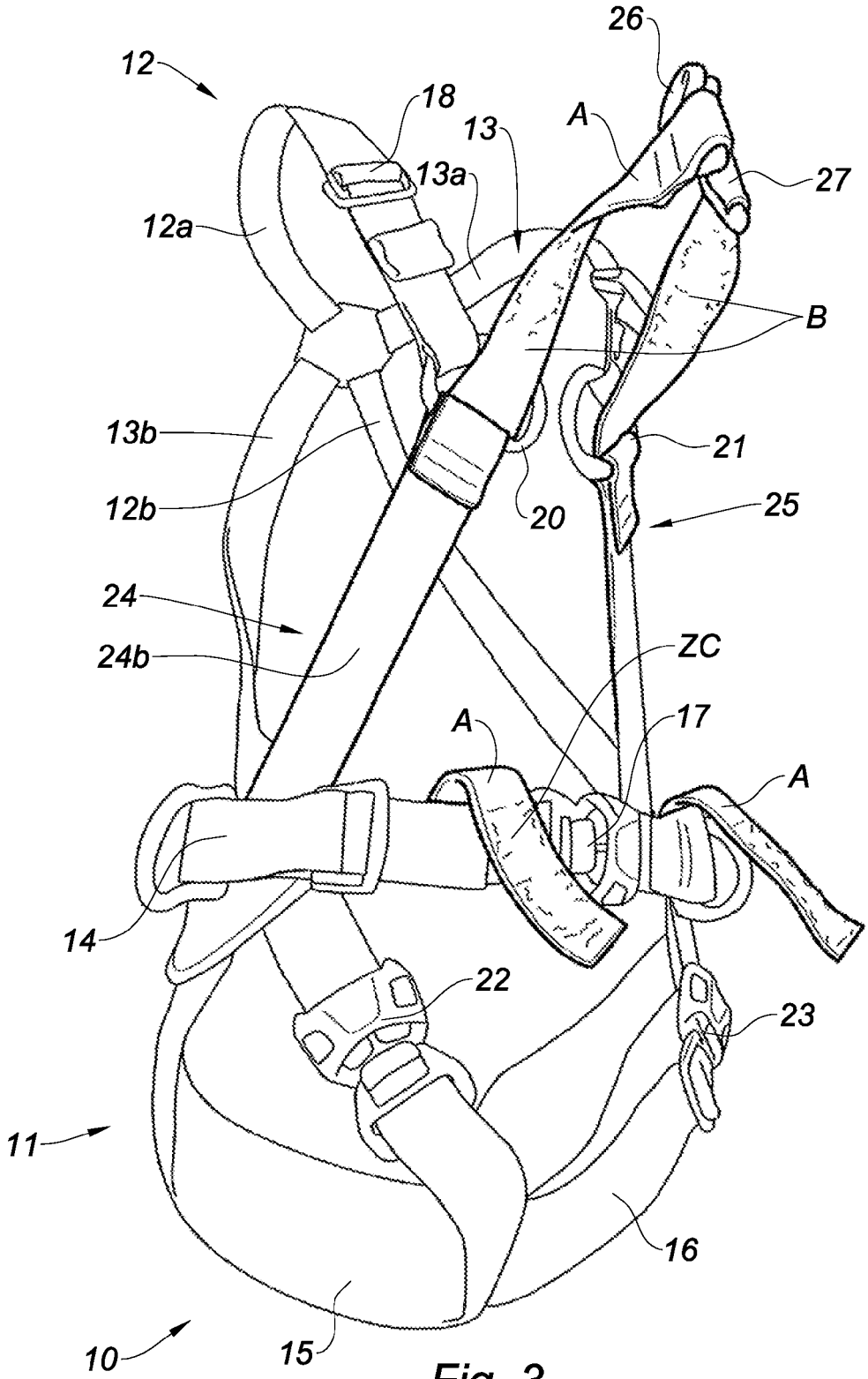
FIG. 3 shows the end of the tearing phase of the stitching area of the link, with the two connecting loops located in the raised position, above the centre of gravity of the user, and above the level of the sternal attachment loops.

In FIGS. 1 to 3, a roping harness 10 is composed of a sit harness 11 associated with a pair of shoulder straps 12, 13 criss-crossing over one another on the user's back. The sit harness 11 comprises a support belt 14 designed to surround the user's waist, and a pair of leg loops 15, 16 connected to the belt 14 on each side of the central closing loop 17.

Each shoulder strap 12, 13 comprises a chest strap 12*a*, 13*a* at the front extended at the rear by a back belt 12*b*, 13*b* so as to pass over the user's shoulder. Depending on the size of the user, the chest strap 12*a*, 13*a* is adjustable in length by means of a first adjustment loop 18, 19.

The front ends of the two chest straps 12*a*, 12*b* of the shoulder straps 12, 13 are fixed at the front to two sternal attachments 20, 21 in the form of rings.

The rear ends of the back belts 12*b*, 13*b* of the shoulder straps 12, 13 are attached to the belt 14. Each sit harness 15, 16 has a second adjustment loop 22, 23 to adjust the perimeter according to the user's morphology.

A pair of securing links 24, 25 are further provided at the front of the harness to connect the shoulder straps 12, 13 to the sit harness 11. Each securing link 24, 25 comprises a first strap 24*a*, 25*a* unfurlable in the lengthwise direction supporting a connecting loop 26, 27 at the end, and a second strap 24*b*, 25*b* connecting the corresponding sternal attachment 20, 21 to an extension of the strap of the sit harness 15, 16.

The two connecting loops 26, 27 form a double connection point for a connector (not shown), which is designed to be connected by a flexible lanyard to a mechanical fall arrest device (not shown). This safety fall arrest device is independent from the harness 10, being for example mounted sliding along a rail or a fixed lifeline. Such a fall arrest device follows the user during his upward or downward progression along the rail. In the case of the user falling, the fall arrest device switches automatically from the released state to the blocked state so as to stop the fall and secure the user. The latter is then attached to the rail or to the lifeline by the lanyard.

The first lengthwise-unfurlable straps 24*a*, 24*b* are designed to make the positioning of the double connection point of the connecting loops 26, 27 vary when a fall occurs. The double connection point of the connecting loops 26, 27 then moves from the lowered position located in the vicinity of the level of the belt 11 (FIG. 1) to the raised position (FIG. 3) located above the level of the sternal attachments 20, 21. The second straps 24*b*, 25*b* connect the straps of the leg loops 15, 16 to the corresponding sternal attachments 20, 21 throughout this movement.

According to the embodiment illustrated in FIGS. 1 to 3, the unfurlable first strap 24*a*, 25*a* of each securing link 24, 25, comprises two strands A, B pressed and held against one another by a stitching area ZC which is configured to resist up to said predefined tension threshold. It is clear that the stitching can be achieved by equivalent means, in particular self-fastening closing strips.

The bottom strand A of the first strap 24*a*, 25*a* is attached to the belt 14, whereas the top strand B is not. The latter supports the connecting loop 26, 27 at its bottom end, and is permanently fixed to the sternal attachment 20, 21 via its opposite end. The bottom strand A is not attached to the sternal attachment 20, 21, and its length is chosen to be smaller than that of the superposed strand B. In case of tearing of the stitching area ZC (FIG. 3), the link of the bottom strand A with the corresponding sternal attachment 20, 21 is interrupted.

Operation of the harness 10 according to the invention is as follows:

In FIG. 1, the stitching area ZC holds the two strands A, B of the first strap 24*a*, 25*a* against one another so as to position the double connection point of the connecting loops 26, 27 in the lowered position, just above the closing loop 17 of the belt 14. This position is advantageously situated close to the centre of gravity of the user and corresponds to the normal progression phase along the rail or lifeline. Sliding of the fall arrest apparatus does not cause tearing of the stitching area ZC.

In the event of the user falling, the tension exerted on the top strand B causes progressive tearing of the stitching area ZC (FIG. 2). The strand B with its connecting loop 26, 27 detaches itself from the bottom strand A in the direction of the sternal attachment 20, 21.

In the position of FIG. 3, tearing of the whole of the stitching area ZC has resulted in separation of the two strands A, B of the first unfurlable strap 24*a*, 25*a* over the whole of the length. The bottom strand of each unfurlable strap 24*a*, 25*a* is floating but remains fixed to the belt 14. The totally detached top strand B is attached to the sternal attachment 20, 21. Maximum elongation of the two securing links 24, 25 places the double connecting loop 26, 27 above the centre of gravity of the user and beyond the level of the two sternal attachments 20, 21. The reaction of the shock undergone when the user falls is totally transferred onto the second strap 24*b*, 25*b* connected with the leg loops 15, 16. Such a raised position of the double connecting loop 26, 27 enables the user to be comfortably secured in case of a fall.

Figure 4:
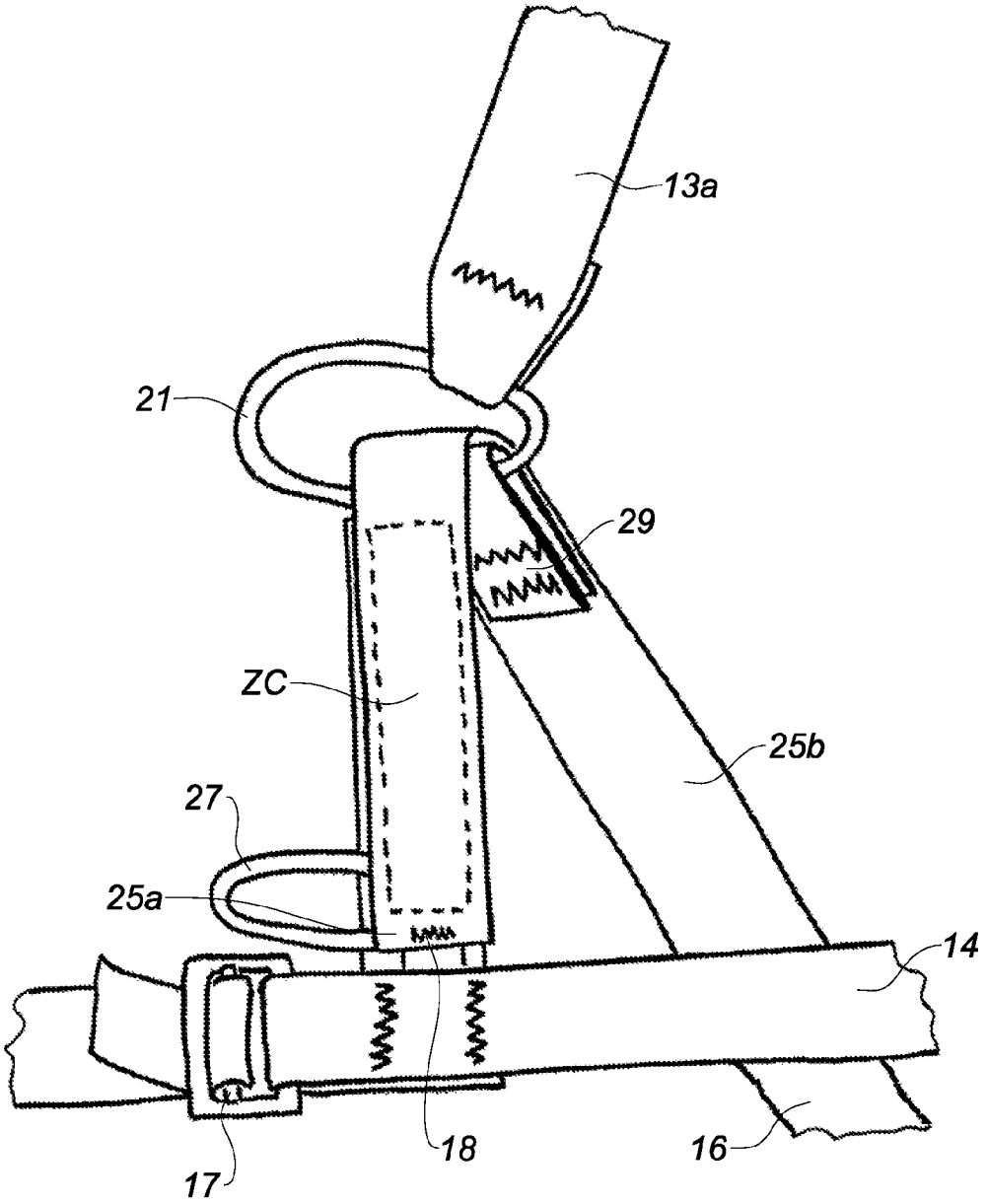
FIGS. 4 and 5 illustrate views of details of the two straps constituting the securing links of FIGS. 1 and 3.
Figure 5:
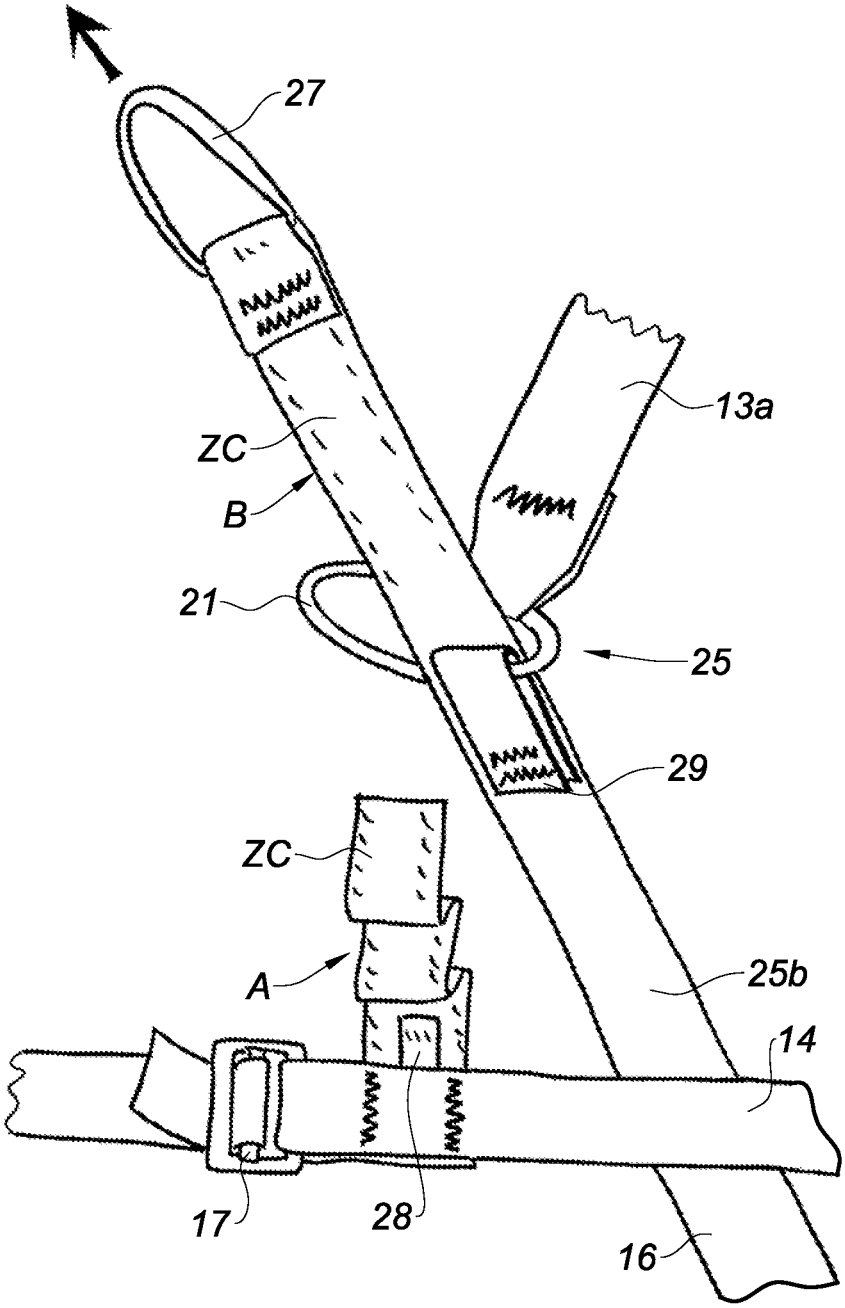

FIGS. 4 and 5 illustrate views of details of the two straps 25*a*, 25*b* constituting the right-hand securing link 25 of FIGS. 1 and 3, respectively before and after tearing of the stitching area ZC, i.e. when the connecting loop 27 is in the lowered position and in the unfurled raised position.

It can be noted that the sternal attachment 21 acts as common attachment means for the chest strap 13*a* of the shoulder strap 13, the second strap 25*b*, and the unfurlable strand B of the first strap 25*a*. A fusible stitching 28 is advantageously provided on the first strap 25*a* between the pressing stitching area ZC and the belt 14. FIG. 5 shows the fusible stitching 28 unstitched on the strand A after tearing. A resistant stitching 29 connects the second strap 25*b* and the top end of the strand B of the first strap 25*a* to the sternal attachment 21. This results in the connecting loop 27 being separated from the belt 14, and the forces being taken up by the sternal attachment 21 connected to the shoulder strap 13*a* and the second strap 25*b* in extension of the sit harness 16.

The invention claimed is:

1. A roping harness comprising:

a sit harness composed of a support belt and a pair of leg loops, a pair of shoulder straps, each of the shoulder straps comprising a chest strap extended by a back belt, said chest strap having a front end attached to a sternal attachment, at least one connecting loop designed to be connected to a fall arrest apparatus, and at least one securing link having (1) a first strap unfurlable in the lengthwise direction, the first strap comprising two superposed strands secured to one another by a safety stitching area, which is designed to tear in the event of a fall to separate the two strands and to move the at least one connecting loop from a lowered position to a raised position, and (2) a second strap connecting the sternal attachment to the sit harness, wherein:

the two superposed strands include a bottom strand and a top strand, the top strand being unfurlable, the bottom strand has a first end attached to the support belt and a second end stitched to the top strand by the safety stitching area, the bottom strand having a length that is shorter than a length of the top strand, the at least one connecting loop is supported by a bottom end of the top strand and is above a closing loop of the support belt when in the lowered position, the top strand is fixed to the sternal attachment, such that tearing of the safety stitching area releases the bottom strand from its connection to the top strand, whereas the top strand moves to the raised position remaining attached to the sternal attachment so as to transfer a reaction of shock undergone when a fall occurs onto the second strap which is connected with the leg loops, and a mechanical connection of the bottom strand with the corresponding sternal attachment, via the top strand, is interrupted when tearing of the stitching area takes place such that the first end of the bottom strand remains attached to the support belt, and the second end of the bottom strand is capable of moving freely relative to the top strand.

2. The roping harness according to claim 1, wherein:

the at least one connecting loop is two connecting loops, and the at least one securing link is two securing links, and the maximum elongation of the two securing links is capable of placing the two connecting loops above the center of gravity of the user and beyond the level of the two sternal attachments.

3. The roping harness according to claim 2, wherein the two connecting loops form a double connection point for a connector.

4. The roping harness according to claim 1, wherein the sternal attachment acts as a common attachment for the chest strap of the shoulder straps, the second strap, and the top strand of the first strap.

5. The roping harness according to claim 1, wherein an auxiliary fusible stitching is provided on the first strap between the safety stitching area and the support belt.

6. The roping harness according to claim 1, wherein the first end of the bottom strand is stitched to the support belt.

7. The roping harness according to claim 1, wherein the front end of the chest strap extends through the sternal attachment and is stitched over itself.

8. The roping harness according to claim 1, wherein the second strap and a top end of the top strand are connected to the sternal attachment by a resistant stitching.

9. The roping harness according to claim 1, wherein the second strap connects the sternal attachment to one of the leg loops of the sit harness.

* * * * *